United States Patent [19]

Heisler

[11] 4,072,090

[45] Feb. 7, 1978

[54] APPARATUS AND METHOD FOR AUTOMATICALLY FEEDING AND ERECTING FOLDED CARTONS

[76] Inventor: Raymond A. Heisler, 657 Dakota Trail, Franklin Lakes, N.J. 07417

[21] Appl. No.: 698,401

[22] Filed: June 21, 1976

[51] Int. Cl.[2] ..... B31B 1/80

[52] U.S. Cl. ..... 93/53 M; 93/53 SD; 221/298

[58] Field of Search ..... 93/53 R, 53 SD, 53 M; 198/773, 774; 271/8 A, 30 A, 104, 149, 167; 214/8.5 K; 221/298

[56] References Cited

U.S. PATENT DOCUMENTS

| | | | |
|---|---|---|---|
| 3,105,610 | 10/1963 | Aidlin et al. | 221/298 X |
| 3,283,955 | 11/1966 | Crabtree | 221/298 X |
| 3,443,706 | 5/1969 | Phum | 214/8.5 K X |
| 3,527,367 | 9/1970 | Bivans | 221/298 X |
| 3,664,521 | 5/1972 | Feher | 221/298 X |
| 3,814,000 | 6/1974 | Heisler | 93/53 SD |
| 3,968,623 | 7/1976 | Langen | 93/52 X |

*Primary Examiner*—Roy Lake
*Assistant Examiner*—Paul A. Bell
*Attorney, Agent, or Firm*—Ralph R. Roberts

[57] ABSTRACT

An apparatus and method is disclosed for improvements in the receiving of folded cartons in a vertical manner and in a storage chute having a beam transport and reciprocating this beam in such a controlled manner so that on the forward stroke this beam is lifted to advance the cartons at a selected rate. From this horizontal chute and the reciprocated beam the cartons are delivered to a relatively horizontal delivery chute from which they are drawn one-at-a-time for erecting. Positive carton edge engagement and release is provided in a novel escapement means so that irregularly made cartons can be accommodated for delivery at a regular rate. This novel escapement insures that only one carton is engaged and pulled from the chute when engaged by the vacuum cups on the swinging suction arm of the erecting station. To insure that an adequate vacuum is present at the occasion of the initial pressing of the suction cups to the lowermost carton there is provided a vacuum assist which is terminated automatically when a determined level of vacuum in the suction system is reached.

20 Claims, 13 Drawing Figures

APPARATUS AND METHOD FOR AUTOMATICALLY FEEDING AND ERECTING FOLDED CARTONS

CROSS REFERENCE TO RELATED PATENTS

This application relates to improvements in carton feeding and erecting as shown in the apparatus and method disclosed in U.S. Pat. No. 3,814,000 as issued on June 4, 1974 and in U.S. Pat. No. 3,848,394 as issued on Nov. 19, 1974 and in U.S. Pat. No. 3,858,490 as issued on Jan. 7, 1975 to the inventor of the above-captioned improvement application.

BACKGROUND OF THE INVENTION

1. Field of the Invention

With respect to the classification of art as established in the United States Patent and Trademark Office the present invention pertains to the Class entitled, "Paper Manufacture" (Class 93) and to the subclass thereunder entitled, "Box machines refolding and/or opening - pivoted suction devices and methods" (subclass 53 SD and 53M)

2. Description of the Prior Art

Erecting cartons from a flat storage condition is, of course, well known and as an apparatus and method is shown in many machines and patents. In the present invention the flat cartons are presented to a supply hopper in a more-or-less vertical condition. Whereas in the related patents, above mentioned, the containers are advanced by an intermittently advanced toothed belt the present invention utilizes a reciprocated platform positioned in the supply chute. This platform is raised above a support frame during a forward stroke portion and is lowered below this support frame for the return stroke portion. By varying the length and frequency of stroke of the platform the cartons carried thereby are supplied in a sufficient amount to a delivery chute whereat the cartons are guided to and repose in a substantially horizontal stored condition.

Insofar as is known, prior art devices utilizing vacuum cups and swinging arms are quite limited in their ability to accept deviations in the size construction of the cardboard cartons. The present invention provides an escapement gate which accommodates variations in carton size construction much in excess of the feeding gates previously known or employed in carton erecting mechanisms.

Where the vacuum supply is achieved by moving a pneumatic cylinder, the initial vacuum is quite low during the beginning movement of the cylinder which provides this source of vacuum. This method of vacuum supply is particularly shown in U.S. Pat. No. 3,848,394, above-identified. In the present invention is provided a vacuum booster means to insure an adequate supply of vacuum to the suction cups carried on the arms as the cups are brought into engagement with the side of the folded carton to be erected. This carton is at the discharge end of the delivery chute and when a determined level of vacuum is achieved in the vacuum system provided by the movable pneumatic cylinder the initial assist is terminated with the larger level of vacuum provided by this cylinder.

In the present invention as in the prior art inventions, above-identified, from the storage chute the folded cartons are withdrawn one-at-a-time by commonly reciprocally rotatable arms, each of which carries a vacuum cup. These cups are pressed against the exposed lower side of the lowermost carton and with vacuum grip the carton to remove this carton from the chute and bring this carton to an erected condition in a transfer apparatus as described more fully in the above-identified patents.

As in the above-identified inventions, the present invention in the movement of the suction arms uses a lost motion for both the grasping movement for the carton and the movement for the release of the carton. This lost motion insures that the pull needed to remove the carton is achieved through a vacuum assist. When a desired vacuum is achieved the assist vacuum is terminated automatically.

SUMMARY OF THE INVENTION

This invention may be summarized at least in part with reference to its objects.

It is an object of this invention to provide, and it does provide, a method and apparatus for automatically feeding folded cartons to an erecting station in a quantity as great as or greater than the demand of an associated automatic packaging apparatus for erected cartons.

It is a further object of this invention to provide, and it does provide, a method and apparatus for feeding and erecting folded cartons in which the transfer of a supply of cartons from a vertical to a horizontal stack is achieved by the forward movement of a reciprocating platform which in its forward motion is caused to be raised above a fixed carton support to engage the bottom of the vertically arranged cartons and with the forward travel of this frame supplies cartons in excess of the demand. Upon the return stroke this reciprocated platform as it is moved passes below this fixed carton support upon which the just advanced and vertically disposed cartons are arranged. The end of this delivery chute is at the end of this reciprocated frame and includes a downwardly directed receiving chute whereby the cartons from the vertical condition are caused to be delivered to a more-or-less horizontal condition. From this horizontal stack the swinging arms and the associated cups are used to pull the lowermost carton from the supply chute. During the movement from this chute to a delivery station the carton is erected by erecting guides and cam means as shown in the prior art devices. Whereas in the prior art devices vacuum is supplied by the actuation of a pneumatic cylinder, in the present invention there is also a vacuum assist to the suction system which is actuated at the beginning of the carton removal stroke. This vacuum assist is in addition to the vacuum system previously described in the above-noted patents. A novel carton escapement having a carton support and separating blade is actuated by a pneumatic cylinder and accommodates wide variations in carton construction.

In brief, this invention provides a guide chute in which cartons are arranged in a vertical condition and on their edges in this delivery chute are advanced by a reciprocating platform. This platform is raised during its forward movement from a position below a pair of carton support ribs and on its return stroke is brought below these support ribs to provide the reciprocating platform with a rectangular path or wave pattern. This platform is moved by a pneumatic cylinder which is adjustably controlled so that an overcrowding or jam condition of the cartons is deliberately created. When this condition occurs the cylinder fails to move the platform forward. This platform and the cylinder actuating this platform are contemplated to deliberately be programmed to overtravel and overcarry the cartons forwardly so that an adequate supply of cartons is available at all times.

At the end of this delivery platform the cartons are delivered to a downwardly directed chute where the cartons come to rest in a more-or-less horizontal condition in side guides. At one end of this chute a new and novel pneumatically actuated carton escapement means is provided which accommodates wide variations in carton manufacture including variations in the width of the cartons. The prior art spring gate escapement mechanisms usually provided which often release more cartons than desired because of the inaccuracy of carton manufacture are not used in this particular embodiment. The prior escapement apparatus in the above-identified patents has been supplanted by the pneumatically actuated escapement to be hereinafter more fully described.

In order to insure that the vacuum cups, each of which is carried on the end of a swinging arm, have sufficient initial vacuum to remove the carton from the delivery stack there is provided an auxiliary vacuum which provides an initial supply of vacuum to the several cups at the time these cups are brought into engagement with the side of the lowermost carton. As soon as the pneumatic cylinder which provides the source and supply of vacuum to these cups has been moved to the extent necessary to provide a sufficient level of vacuum, the auxiliary supplied vacuum is automatically shut off. This initial vacuum supply and the vacuum produced by the actuated pneumatic cylinder is utilized to withdraw and erect the carton carried by the several suction cups.

In addition to the above summary the following disclosure is detailed to insure adequacy and aid in understanding of the invention. This disclosure, however, is not intended to prejudice that concept to be hereinafter disclosed no matter how it may later be disguised by variations in form or additions of further improvements. For this reason there has been chosen a specific embodiment of the apparatus for automatically advancing vertically arranged cartons, releasing by a pneumatically actuated escapement the lowermost carton and erecting this carton. This specific embodiment has been chosen for the purposes of illustration and description as shown in the accompanying drawings.

BRIEF DESCRIPTION OF THE DRAWINGS

In the following description and in the claims various details are identified by specific names for convenience, these names, however, are intended to be generic in their application. Corresponding reference characters refer to like members throughout the several figures of the drawings.

Figure 1:
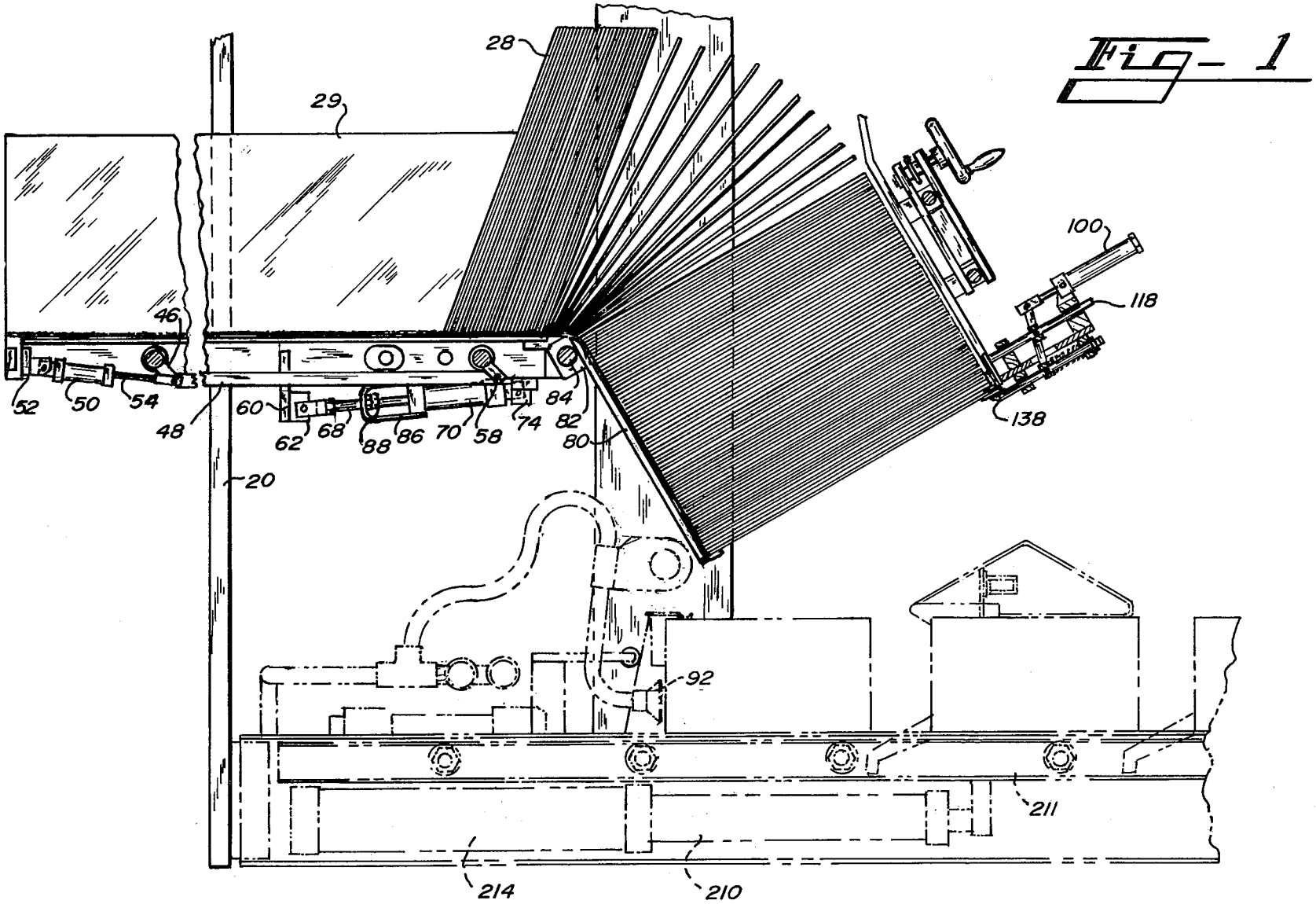
FIG. 1 represents a side view, partly diagrammatic, and showing the relationship of the carton transport, escapement mechanism and erecting mechanism.

The drawings accompanying, and forming part of, this specification disclose certain details of construction for the purpose of explanation but it should be understood that these structural details may be modified and incorporated in other structural forms than shown.

DESCRIPTION OF THE PREFERRED EMBODIMENT OF FIGS. 1 THROUGH 6

Referring now to FIGS. 1, 2A, 2B, 3, 4, 5 and 6, it is to be noted that a general support frame 20 includes right and left channels 22 and 24 which have applied or mounted on their upper surface an antiskid material in the way of rubber belting and/or a support surface identified as 26. This surface prevents the unwanted back and forth movement of cartons 28 which preferably are stacked in a vertical condition and are retained in this condition by side guide means 29. Reciprocably carried by and between these channels 22 and 24 is a platform generally identified as 30.

This reciprocating platform includes in-turned angle members 32 and 34 which carry on their top surface an anti-slip belting 36 or like device which provides an antiskid surface to the cartons 28 when they are lifted and transported forward. In the downturned portions of the angles 32 and 34 are formed holes in which flange bearings 38 are mounted and provide for the rotational movement and securing of axle 40 on which flange rollers 42 are mounted. The ends of these axles 40 are reduced in diameter and eccentrically positioned so as to carry the rollers in an offset manner so that as and when the axle 40 is moved approximately 120°, or one-third of a full circle, the carton carrying surfaces 36 are from approximately one-quarter of an inch below the fixed support surfaces 26 to approximately a quarter of an inch above these support surfaces 26. Actuation or movement of these axles 40 is by moving the attached actuating arms 44 and 46 secured to these axles 40. A drag link 48 extending between arms 44 and 46 is actuated by cylinder 50. This cylinder is attached at its clevis end 51 to a cross tie 52 which supports and spaces in fixed array one end of the angles 32 and 34. Attached to this cross tie 52 is a retaining block 53 which carries the clevis end 51 of the cylinder 50. Piston rod 54 of this cylinder 50 has a clevis connector 55 which is retained by a pin 56 and moves the arm 46 which is welded and secured to the rear axle 40. Pin 58 carries and secures the drag link 48 to the welded on actuating arm 44 secured to the front axle 40. A front tie or brace member 60 is secured to both angle 32 and 34 to retain them in a fixed spaced relationship. As reduced to practice, this front tie member 60 extends below the angles to provide a support for tongue 62. On this tongue a clevis 64 is retained by clevis pin 66. A piston rod 68 which carries this clevis is movable by cylinder 70. Cylinder 70 is retained at its rear or closed end by support bar 72 which extends from the channel 22 to channel 24 and ties these two channels together to provide a support for these channels. A clevis support 74 is secured to bar 72 which retains tongue end 76 of the cylinder 70. Pin 78 retains this tongue end to clevis support 74. The forward portion of the channels 22 and 24 terminate with a downwardly angled support guide 80 which is retained in position by a leaf member 82 secured to the support guide 80. This guide is pivotally secured to the leaf member 82 by a hinge pin 84. Two or more downwardly directed support guides 80 are provided to support the cartons 28 at a determined angle which is a substantially horizontal condition.

USE AND OPERATION OF THE APPARATUS OF FIGS. 1 THROUGH 6

Figure 4:
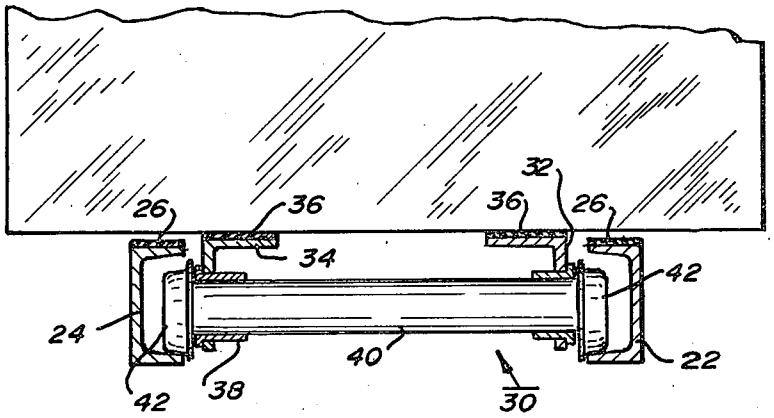
FIG. 4 represents the transverse view of FIG. 3 when and as the reciprocating beam is raised to carton carrying and advancing condition.
Figure 3:
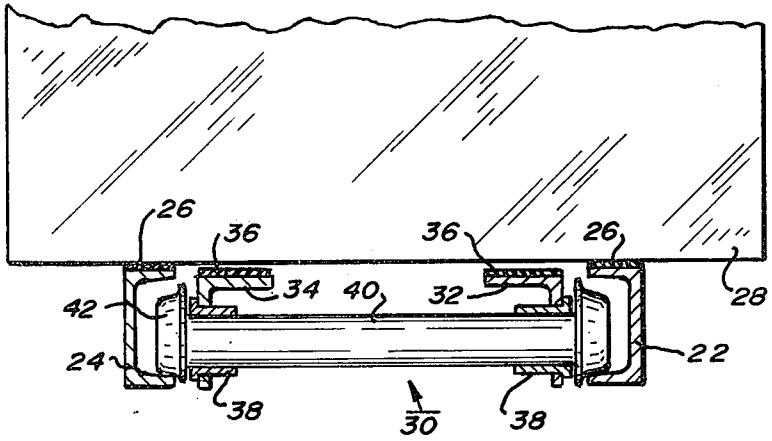
FIG. 3 represents a transverse view of the beam and associated support frame with the beam disposed below the frame and the vertically arranged cartons supported by this frame.
Figure 2B:
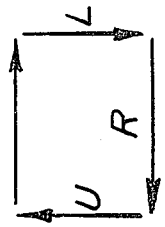
FIG. 2B represents a diagrammatic showing of the movement pattern of the reciprocating beam.
Figure 2A:
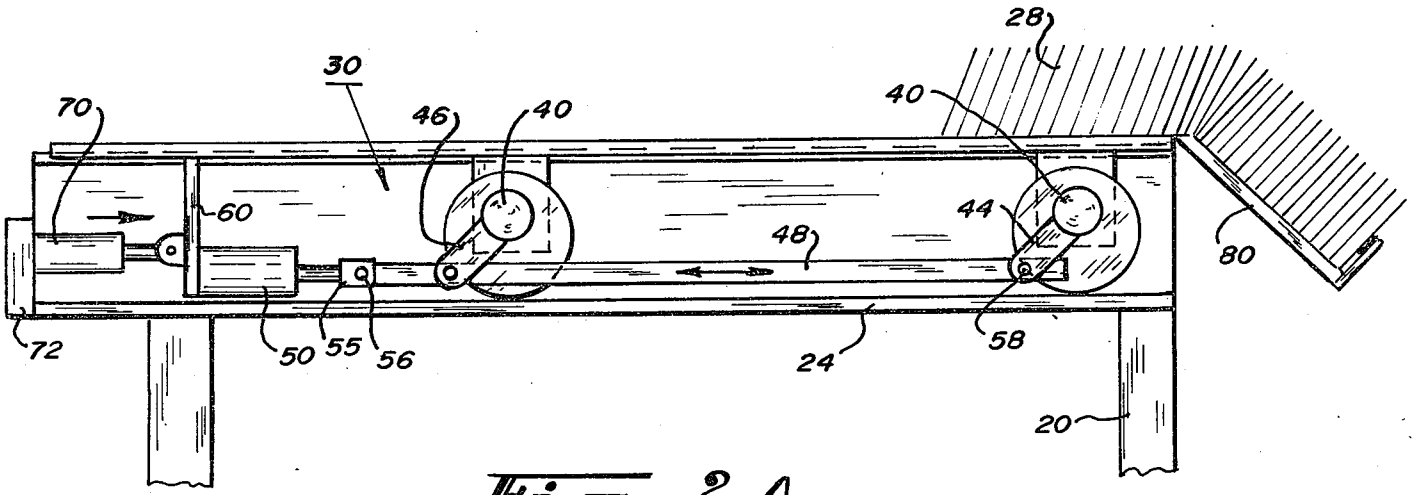
FIG. 2A represents a diagrammatic, side view of the folded carton delivery system of this invention and showing in particular the relationship of the reciprocating beam and the fixed support for the cartons.
Figure 6:
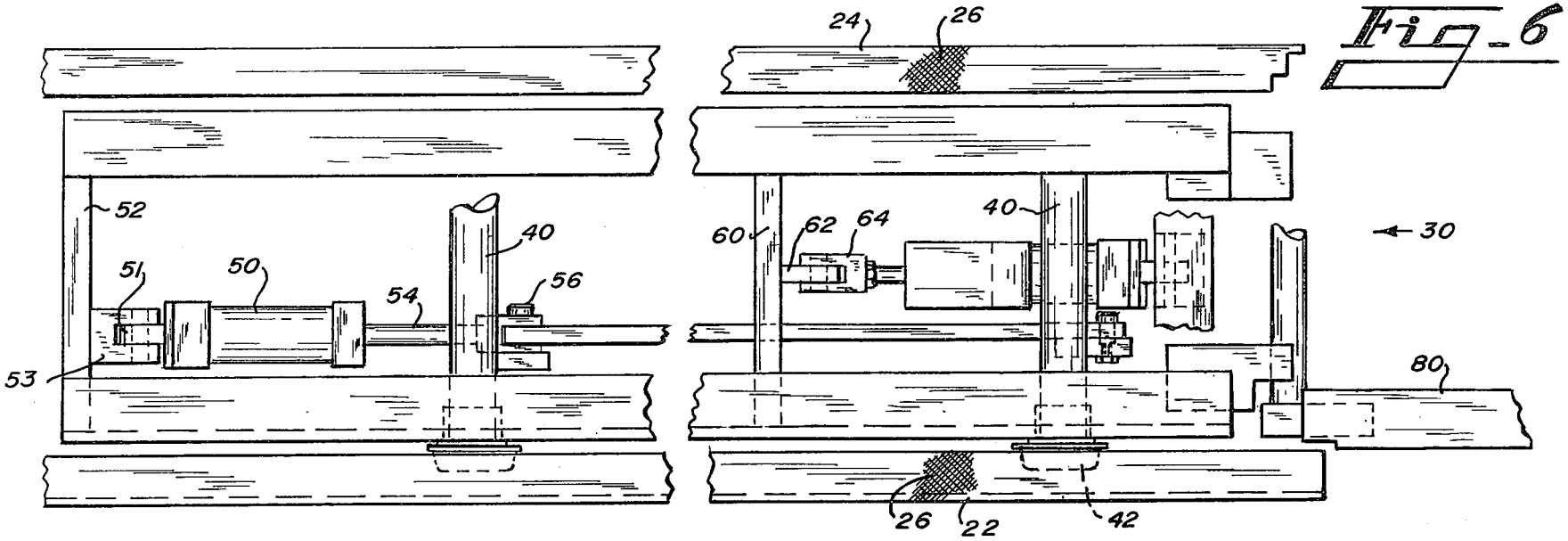
FIG. 6 represents a plan view of the carton delivery apparatus to FIG. 5, this view taken on the line 6—6 thereof and looking in the direction of the arrows.

It is to be noted that the movement of the platform 30 is in a rectangular pattern as shown in FIG. 2B. On the forward stroke identified as *f* the carrying surfaces 36 are lifted approximately a quarter of an inch above the fixed supporting surfaces 26. The platform and the supporting belt or carrying surfaces 36, as seen in FIG. 4, engage the bottom of the cartons 28 and move the cartons forward by a force provided by cylinder 70 as it moves the front tie member 60. The amount of forward stroke is controlled by a limiting stop bracket 86 which is attached to the front end of the cylinder 70. The piston rod 68 passes through a hole in limiting stop bracket 86 and adjusting nuts 88 on the threaded portion of this rod are adjusted to limit the stroke of the cylinder rearwardly. This positioning of the nuts limits the amount of rear and forward travel of the platform.

As seen in FIG. 2B, the extent of forward travel indicated as *f* is equal to the amount of rearward travel indicated as *r*. Cylinder 50 is actuated to push the arms 44 and 46 forwardly and move the axles 40 and the mounted rollers 42, which are in engagement with the inner portions of channels 22 and 24. This movement utilize the eccentricity provided by the axles 40 and when the axles are rotated they cause the angles 32 and 34 to be raised so that the carton engaging surfaces 36 are above the fixed supporting surfaces 26 of the channels 22 and 24.

Figure 5:
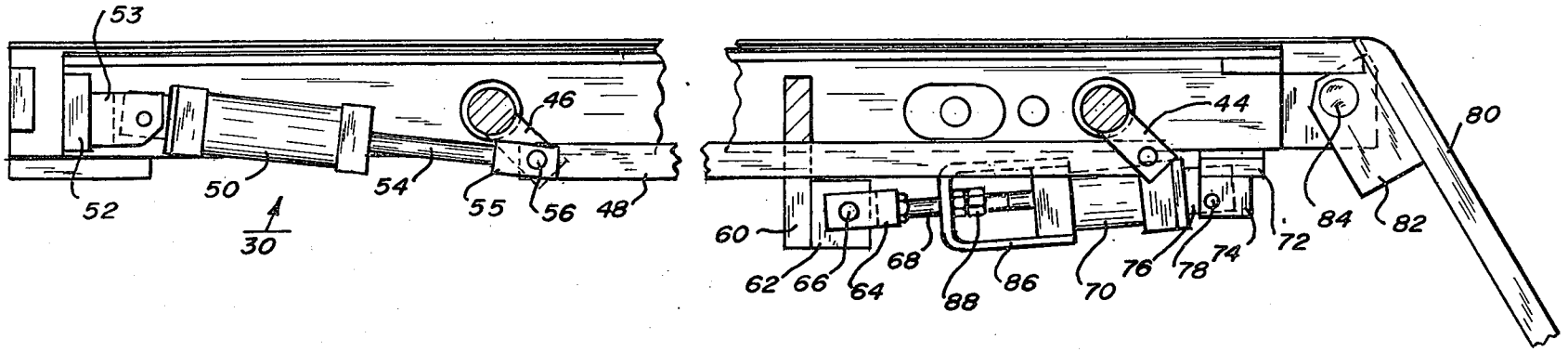
FIG. 5 represents a side view of the carton delivery apparatus and showing the arrangement of the components as used in a reduction to practice carton erecting and case packing mechanism.

The rearward motion provided by cylinder 50 causes the lift of the movable platform, seen in FIG. 4. When moved to the forward position, as seen in FIG. 5, the axles 40 are rotated approximately one-third of a revolution which causes the rollers to be lifted in relationship to the axis of the axles 40 so that the reciprocating frame is position in the condition of FIG. 3 with the carrying surfaces 36 dropped below the support surfaces 26 of the channels. This condition of the platform occurs as the rearward motion of the reciprocating frame is made. No engagement of the carrying surfaces 36 with the edges of the cartons 28 occurs on the rearward stroke of the reciprocating frame. By the timing sequence shown in the circuit diagram the movements of the cylinders 50 and 70 are coordinated to produce the rectangular pattern of the forward and rearward, lower and upward movement of the reciprocating frame, as shown in FIG. 2B. It is to be noted that the cylinder 70 and the supply of pressurized air fed thereto is adjustable so that an adequate supply of cartons is delivered to fill the downward chute. These cartons are now in place or position for withdrawal by swinging arms and attached suction cups, to be hereinafter more fully described. This full supply of cartons causes the cylinder 70 to be ineffective as far as the advancement of additional folded cartons. The defeat of the cylinder action continues until enough cartons have been withdrawn from the chute to enable the cylinder to once again feed more cartons forwardly by the reciprocating frame. It is to be noted that as arranged the larger end of the cylinder 70 is always available to the inflow of air and insures that the platform 30 is at the rear position at the end of every air pulsation. When the platform is raised and if the cartons cannot be advanced forwardly by the cylinder, the platform is still lifted for that period of time the forward advance of the cylinder 50 is programmed. This sequence only allows a certain period of time for the advancement of the cartons. A deliberate overtravel of the platform motion is made. For example, assuming the carton thickness is about three-eighths of an inch it is contemplated that each cylinder stroke will be of a half inch or more resulting in an overtravel of one-eighth of an inch which results in a rapid filling of the chute.

A partly diagrammatic showing of this rectangular pattern is shown in FIG. 2B which depicts the motion of the components controlling the motion of the reciprocating platform. The whole platform is moved by cylinder 70 and the timed eccentric motion for raising and lowering of the platform is provided by the cylinder 50 and the drag link 48 connected to arm members 44 and 46.

CARTON ERECTING MECHANISM AS SEEN IN FIG. 1

Although much of the carton erecting mechanism is fully described in the above-referenced patents it is to be noted that the cartons 28 are deposited on the rails and the antislip surfaces 26 of the chute. The movable platform then advances the cartons to the angled support guides 80.

Adjustably carried on the opposite sides of the support guides 80 and defining an angled carton-retaining means is a pair of guide rails 89. These rails are carried on threaded studs 90 extending through a header member 91 attached to and supported by frame 20. On the forward or downward end of each of the rails 89 is provided the carton escapement apparatus, to be hereinafter more fully described. This escapement engages and supports the stack of cartons and particularly the lowermost carton which is removed by suction cups 92. Extending inwardly a short distance from each side of the chute is an ear or tab 93 disposed to engage this lowermost carton at its outer edge to prevent sagging or unwanted dropping of this carton. In an alignment with the downwardly sloped extent of the support guides there is provided a pair of stops 94 which engage the lower edge and face of the carton to prevent its dropping or accidental displacement from the chute until the carton is removed by means of suction cups 92 carried on arms 95.

As reduced to practice, there are four suction or vacuum cups 92, each attached to an arm 95. Each arm is a bent tube carried in a bracket 96 secured to shaft 97 and moved therewith. A flexible tube or conductor 98 is attached to each arm 95 at the bracket 96 and at the other end each tube is connected to a header member 99 which is connected by a line or pipe to a cylinder and a gauge, as described in the above-referenced patents. A piston is moved by another connected power cylinder to actuate the apparatus for erecting and transporting a carton as also described in the above patents. A stop is disposed to engage a carton and to limit and retain the upper edge of this carton as it is being erected. A guide finger engages and retains this erected carton during the erection and retaining sequence.

CARTON ESCAPEMENT ASSEMBLY OF FIGS. 7 THROUGH 11

Figure 7:
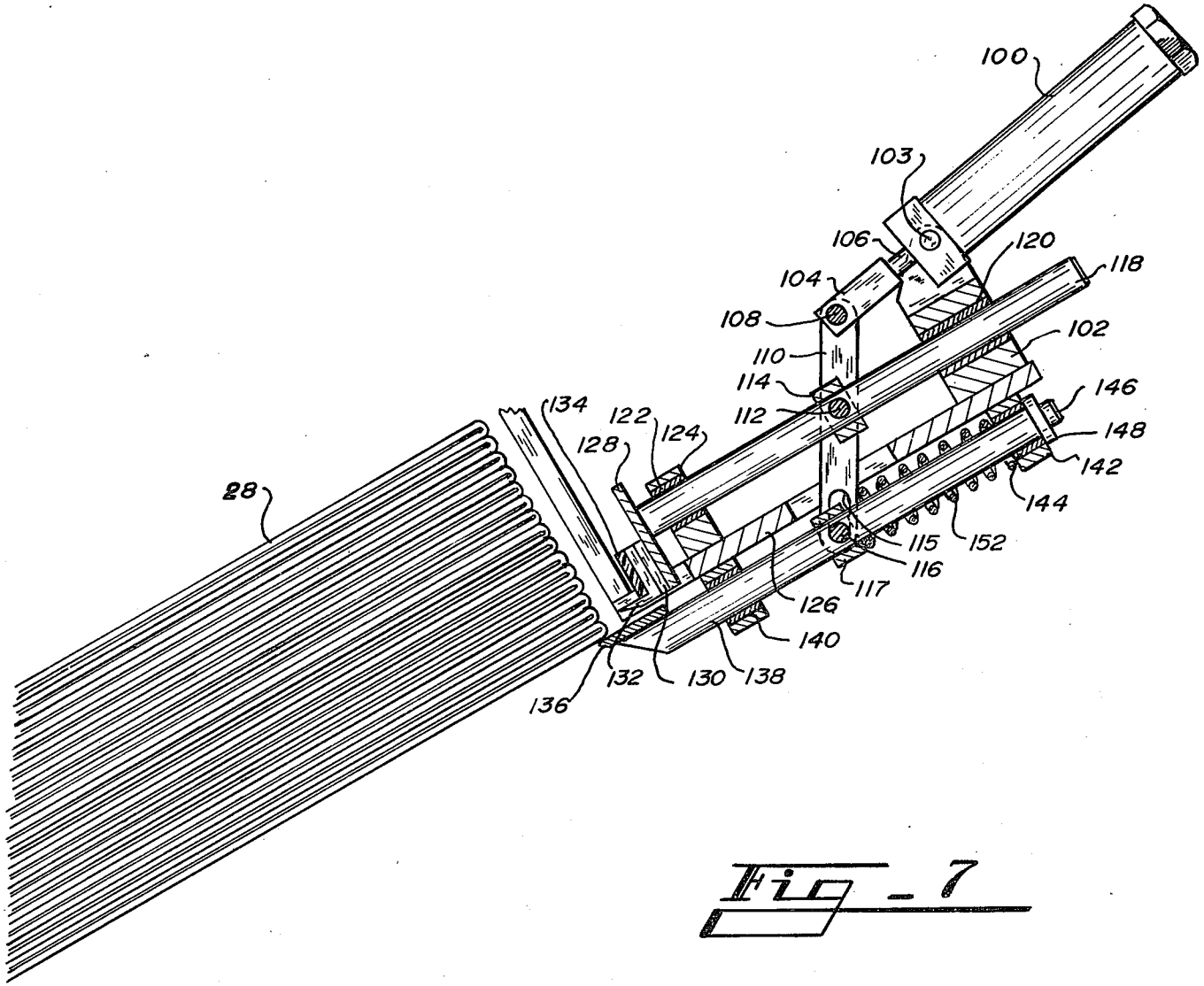
FIG. 7 represents a side view, partly in section and in an enlarged scale, and showing in detail the escapement mechanism for the folded cartons, this view showing the cartons and the escapement mechanism in the initial carton supporting condition.

Referring next to FIGS. 7, 8, 9, 10 and 11, there is depicted a supply of folded cartons 28 which is fed by the apparatus and delivered and erected by the apparatus as shown in FIGS. 1 through 6. As illustrated in FIG. 7, the carton escapement apparatus is in repose. An escapement cylinder 100 is carried by and on a trunion block 102 so as to be pivoted around trunion portions 103 secured to the rod end of the cylinder 100. A clevis 104 is carried on the piston 106 of the cylinder 100 and moves back and forth in accordance with the input of air into the cylinder. Pivot pin 108 retains one end of a pair of levers or links 110 to the clevis or block 104. These links are pivotally retained on the pins 112 carried on a pivot block 114. This pivot pin 112 passes through both the block and the side portions of the links 110. The lower portions of these links are slotted at 115 to permit a swinging accommodation of lower pivot pin 116. The lower end of the links 110 are carried by and move a pivot block 117 through which passes the pivot pin 116.

A rod 118 is carried by pivot pin 112 and block 114 and is slidable in a bearing 120 carried in trunion block 102. The forward end of the shaft 118 is carried in a bearing 122 mounted in block 124 which is fixedly attached to a base plate 126. Base plate 126 also carries the trunion block 102 which may be attached as by welding or other means of attachment such as cap screws.

On the forward end of shaft 118 is carried forward carton stop 128. Forward of the lower end and adjacent this carton stop is a spacer 130 which provides the desired spacing between the carton stop 128 and a carton stop blade 132. This blade is an L-shaped member having its lower forwardly extending portion sharpened or brought to an edge so that it may readily penetrate the space between the curved edges of cartons. On the forward portion of this carton stop blade 132 is carried a rubber stop pad 134 for a purpose to be hereinafter more fully described. A carton support or pad 136 is carried on the forward end of lower shaft 138. This support 136 carries the lowermost carton and all above cartons when the carton escapement is in the condition of FIG. 7.

The lower carton support 136 is attached to shaft 138 which is slidably carried on a forward portion of the shaft in a bearing 140 mounted in block 124. The rear end of this shaft 138 is supported by bearing pad 142 which carries bearing 144 which slidably retains the rear portion of the shaft. A cap screw 146 and a washer 148 are mounted on the rear end of shaft 138 to provide a limiting forward stop to the shaft. A spring 152 is mounted and is slidable on the shaft 138 and is disposed between the bearing pad 142 and the pivot block 117 to cause the shaft 138 and the lower carton support 136 to be urged leftwardly to the condition as seen in FIG. 7.

CARTON ESCAPEMENT AS SEEN IN FIG. 8

Figure 8:
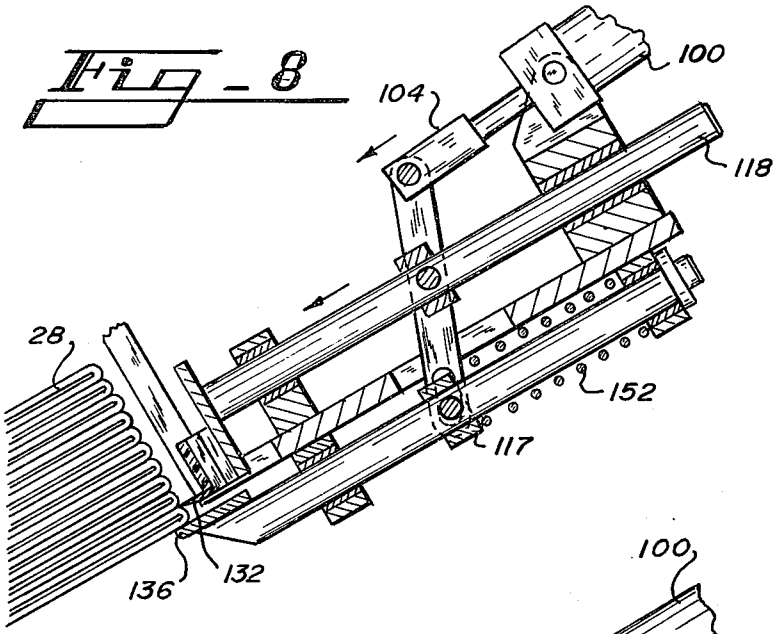
FIG. 8 represents a side view of the escapement apparatus of FIG. 7 and with the apparatus moved sufficiently toward the edges of the cartons for the carton separating and supporting blade to begin its entrance into the space between the lowermost supported folded carton and the next immediately above folded carton.

In FIG. 8 the cylinder 100 has been actuated with a small amount of air causing a small forward motion of the rod 106 and clevis 104. The spring 152 maintains the pivot block 117 in its forward condition and shaft 118 is moved forwardly to cause the carton stop blade portion 132 to begin its entrance between the lowermost and the next above folded carton 28. The cartons in the stack are still supported by the lower carton support 136.

CARTON ESCAPEMENT AS SEEN IN FIG. 9

Figure 9:
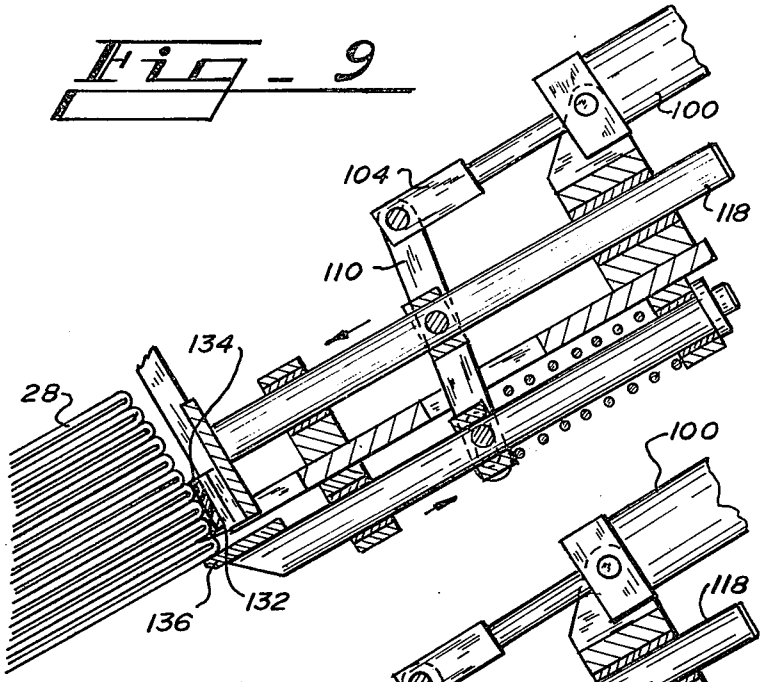
FIG. 9 represents a side view of the escapement apparatus of FIG. 8 with the apparatus further moved so that the carton separating and supporting blade is fully inserted between the folded cartons and a cooperative resilient pad has engaged the edges of a few cartons immediately above the supporting blade and with the carton stop being partly moved to begin release of the bottommost folded carton.
Figure 11:
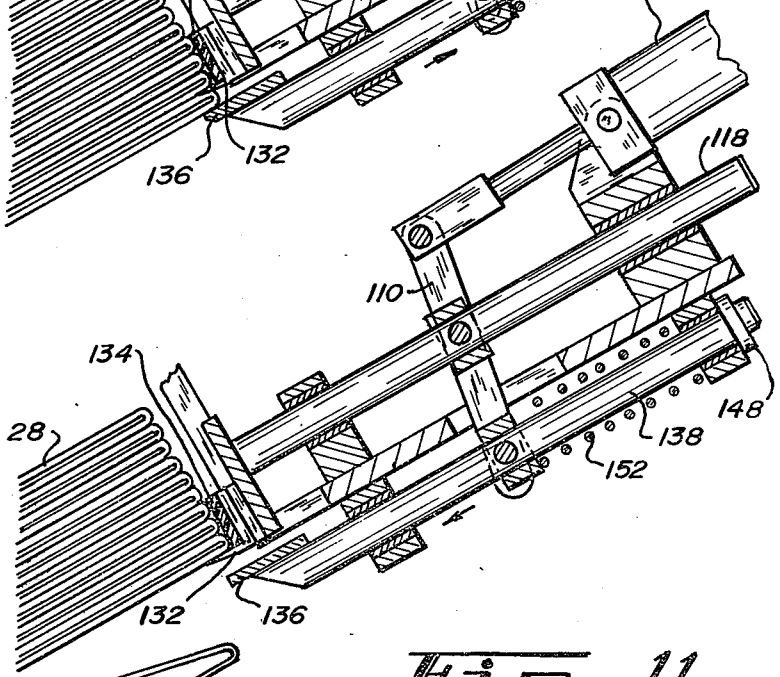
FIG. 11 represents a side view of the escapement apparatus of FIG. 10 with the carton stop nearly returned to its leftward carton support position and just prior to the withdrawal of the supporting blade from the stack of folded cartons to allow the folded cartons in the stack to fall to the carton stop.

In FIG. 9 the carton support is still in place and supporting the stack of cartons 28 and the cylinder 100 has further advanced the clevis 104 forwardly. The levers 110 associated therewith have caused shaft 118 to be advanced in the direction of the arrow sufficiently for the carton stop blade 132 to have fully entered in between the lowermost and the next adjacent carton 28. At this same time the rubber stop pad 134 engages the edges or ends of the three or more cartons above the carton stop blade 132. This engagement of the rubber pad 134 stops the forward progress of the shaft 118 as moved by the cylinder 100.

CARTON ESCAPEMENT AS SEEN IN FIG. 10

Figure 10:
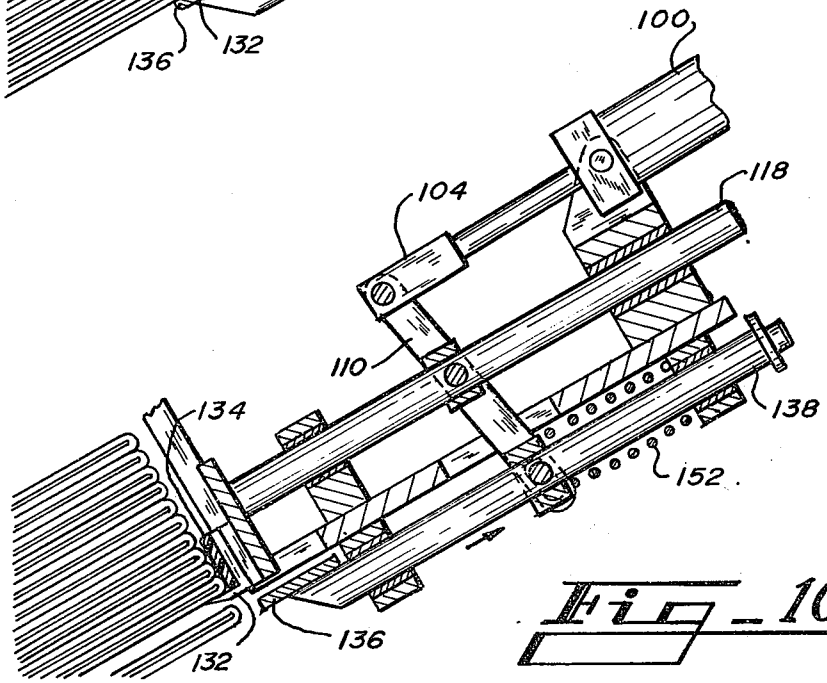
FIG. 10 represents a side view of the escapement of FIG. 9 with the apparatus further moved so that the carton stop has released the bottom carton.

Referring next to FIG. 10, it is to be noted that cylinder 100 has further advanced the clevis end 104 with the levers 110 continuing to move forward. With the engagement and advancement of the rubber stop pad 134 into the edges of the cartons 28, the forward progress of the shaft 118 is stopped and shaft 138 begins to be moved backward to cause the carton support 136 to be moved from beneath the lowermost carton which is now released. The blade stop 132 and the rubber stop pad 134, which is in engagement with the cartons immediately above blade stop 132, retain those cartons still in the stack. The spring 152 is overcome by the forward motion of the cylinder 100 and is slightly compressed, sufficiently to cause the lower carton shelf support 136 to be moved from in way of the lowermost carton to release this carton and permit this carton to be moved by the swinging arms 95 and the vacuum cups 92 attached.

After removal of this lowermost carton, the cylinder 100 is retracted and with the rearward movement of the clevis 104 a clockwise rotation of the arms or levers 110 around the pivot block 112 occurs. Spring 152 exerts its bias to cause the shaft 138 to move forwardly until stopped by the washer 140. This limits the forward position of the shaft. Since the cylinder 100 has not retracted to its full extent, the blade stop 132 is still in position to retain the cartons 28 in the stacked position. It remains in this position until cylinder 100 has fully retracted to cause shaft 118 to be withdrawn to the position of FIG. 7. At this point the stack of folded cartons is released to drop onto the support provided by lower carton support 136. In this manner a timed pneumatic force causes the cylinder 100 to be actuated to cause the release of one carton while the above folded cartons are retained in position by means of the carton stop blade 132. Rubber pad 134 and entering blade 132 accommodate irregularities due to the manufacturing inaccuracies in the carton and wear and tolerance in the machine are accommodated. As reduced to practice, tolerances as great as one-quarter of an inch in the overall width of the cartons are accommodated with no appreciable reduction in the operation and efficiency of the erecting mechanism. As long as the cartons are sufficiently large to accommodate the fitting and placement of the containers therein for which these cartons are made, the efficient and rapid erection of the cartons is accommodated without the problem of pulling the carton past fixed position stops which are necessarily quite limited in their ability to accommodate irregularities in the manufacture of cartons.

CIRCUIT DIAGRAM OF FIG. 12

Figure 12:
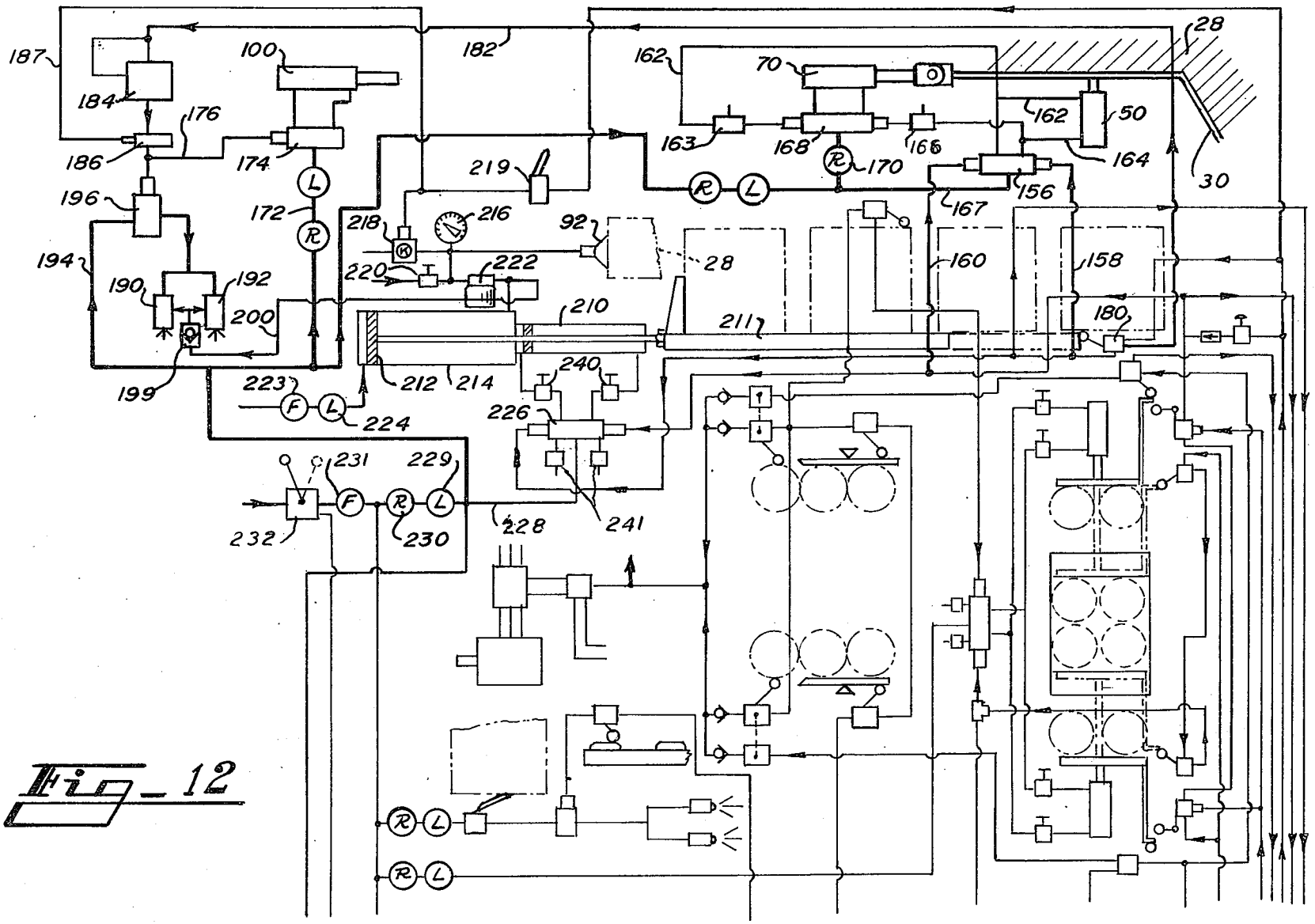
FIG. 12 represents a portion of the circuit diagram of the case packer apparatus as shown in U.S. Pat. No. 3,848,394 as modified to show the actuation and control of the carton advance of the beam movement and the venturi action to produce the initial vacuum force to the suction cups carried on the carton erecting arms, and the actuation of the pneumatic cylinder moving the carton release gate.

Referring next and finally to the circuit diagram of FIG. 12, it is to be noted that this diagram includes substantially all of the components shown in FIG. 20A of U.S. Pat. No. 3,848,394, above-identified. In this circuit is shown a preferred means of electrical and pneumatic operation of the apparatus for erecting and closing a carton as shown in this patent. In this prior patent the power piston 210 moves reciprocated frame 211 by which the cartons are transported. At the same time the power piston moves a vacuum producing piston 212 in a cylinder 214, this piston on the return stroke produces and provides the source of vacuum to the vacuum cups 92 to enable these cups with the assistance of vacuum to grasp the side of the folded carton 28. Gage 216 indicates the amount of developed vacuum in the vacuum system. A valve 218 has one side open to air and is actuated by a hand manipulated valve 219 to bleed or nullify the pull of the vacuum cups 92 when the carton erecting mechanism is to be actuated and operated without pulling cartons from the supply stack. A valve 220 is adjusted to permit a determined amount of air to enter the cylinder 214 during the vacuum stroke. This regulated flow of air limits the vacuum that is obtained in the vacuum system. This air and the air entering through the vacuum cups 92 are passed through a filter 222 to prevent fouling of the cylinder and to reduce wear. The open side of the cylinder 214 is provided with a filter 223 and a lubricator 224. This filter removes unwanted particles present in the atmosphere and the lubricator insures that the piston moves freely in the cylinder.

An automatic spool valve 226 is contemplated to receive sixty pounds of compressed air through conductor 228. In this line is also provided a lubricator 229 and a pressure regulator 230 which reduces the line pressure air which may be 80 pounds or more pressure. Sixty pounds pressurized air in the present instance delivered to cylinder 210 provides an ample force for moving the reciprocating frame 211 but this force is selected so that a stalling occurs when a filled carton becomes jammed in the apparatus. A filter 231 prevents dirt, etc. from blocking ports and causing undue wear in the many control members. A three-way lever controlled valve 232 is opened and closed to permit line supplied pressurized air to be fed to the control system. This system of control for the flap closing apparatus is fully described in U.S. Pat. No. 3,848,394, above-identified. Speed control valves 240 are provided to regulate the rate of travel of the piston in cylinder 210. Mufflers 241 are also provided to reduce the pneumatic exhaust noise as these cylinders are cycled.

To provide the unique and particular requirements for the changes in the apparatus of U.S. Pat. No. 3,848,394 and the novel carton erecting, transporting and feeding apparatus of the present invention, there is provided an actuation of the reciprocating carton transporting platform 30 by the cylinder 50 which is controlled by a valve 156 which is piloted by conductors 158 and 160. Conductor 158 is a pilot for controlling the downward movement of cylinder 50 and the conductor 160 is the pilot which moves spool valve 156 to initiate upward movement of the cylinder 50. The air flow causing the "down" movement of cylinder 50 is carried by conductor 162 which air flow also is fed to a flow-restrictive valve 163. The air flow producing the "up" movement of cylinder 50 is carried by conductor 164, which air is also conducted to a flow-restrictive valve 166. The regulated air fed through valve 163 from conductor 162 pilots valve 168 and starts the return stroke of cylinder 70. The air providing the "down"stroke of cylinder 50 is fed by the air flowing through conductor 162 and also a connected conductor. As regulated by valve 163 the air flows to the left end of valve 168 to actuate the cylinder 70. The air providing the "up" stroke of cylinder 50 is fed by the air flowing from piloted valve 156 through conductor 164. This conductor also carries air to flow-restrictive valve 166 and from this valve to the right end of valve 168 to set this valve for the start of a forward stroke of cylinder 70.

The return stroke of cylinder 70 occurs when a signal is fed to valve 168 from conductor 162 actuating the "down" stroke. The 37 down" and also the "up" strokes are fed by conductors associated with the forward stroke and return stroke conductors. A regulator 170 insures that the air pressure fed to the cylinder 70 does not overcome the resistance of the cartons to mvoement when the supply of cartons has met the demand and the chute is full. Cylinder 100 which actuates the escapement mechanism is fed by air through conductor 172 to valve 174 which is piloted from air carried by conductor 176. The piloting control of valve 226 in addition to actuating this valve and the flow to the power cylinder 210 also on the forward stroke of power cylinder 210 moves the carriage 211 so as to actuate valve 180. This valve, when opened, provides a flow of piloting air to conductor 182 which feeds air to a delayed timer 184 which, when initiated, operates for a determined period of time. A piloted valve 186 is normally open unless an air signal through line 187 is sent when valve 219 is acutated to cause the vacuum system to be rendered inoperative. Air venturi, identified as 190 and 192, are connected to an air supply conductor 194 which leads to and through a pilot valve 196. A check valve 199 in auxiliary vacuum line 200 is connected to the vacuum side of cylinder 214.

USE AND OPERATION OF THE CIRCUIT DIAGRAM OF FIG. 12

In operation it is assumed that the cylinder 210 has moved the carton erecting platform 211 to the forward position whereat valve 180 is actuated. As this platform is moved from the forward position this valve causes a pulse of air to be sent through the conductor 182 to the timer 184. At the same time and by the same means shown in prior references the vacuum cups 92 that are carried upon the end of hollow arms 95, as seen in FIG. 1, are brought in way of the lowermost folded carton 28 in the chute. Vacuum is supplied at the time these cups 92 are pressed against this carton to cause these cups to grip the side of the carton. At this period in the cycle the auxiliary vacuum supply is actuated Timer 184 is set in motion and since there is little or no vacuum at this time developed in the cylinder 214 valve 186 is normally open to permit an air flow to be carried from line 194 to valve 196. Pressurized air from the supply is fed through line 194 and valve 196 into the pair of venturies 190 and 192 to cause a vacuum or suction in auxiliary vacuum line 200 to be developd. This suction flow through line 200 causes an initial vacuum to be applied to the vacuum cups 92. Since the suction flow is in the direction of the arrows, the check valve 199 remains in an open condition during this initial vacuum developing period. As the piston 212 is moved leftwardly in cylinder 214 it brings the platform 211 back to a carton receiving and erecting position during this period of time and the vacuum cups 92 grip the carton to bring the carton into an erected position.

As the vacuum builds or increases in the cylinder 214 by the leftward movement of piston 212, the vacuum reaches a predetermined level and the flow in line 200 is reversed and check valve 199 closes. At the same time the setting control flow in line 176 through and from timing valve 184 actuates valve 174 to cause the cylinder 100 to be actuated. The valve 174, when air is flowing as regulated by the timer 184 and through the venturies 190 and 192 as set by air flowing in line 176, is open to allow air to flow to cylinder 100 and cause it to be moved to the forward condition causing the lowermost carton to be released by the apparatus of FIGS. 7, 8, 9, 10 and 11. This provides an automatic sequencing operation whereby the operation of cylinder 100 is in timed sequence to the initial application of the vacuum cups 92. The resetting of the cylinder 100 causes the containers to be held by the repositioned carton stop 136 (FIG. 7) and thus automatically the release of cartons from the stack is controlled. The supply of cartons as carried by the movable frame is also automatically programmed, as above-described.

As a method the above specification and drawings disclose the method steps for receiving, transporting and presenting for withdrawal the erection of folded cartons for use in case packing apparatus and the like, said steps including providing a fixed frame including side guides establishing a support means for receiving and maintaining folded cartons in a substantially side-by-side condition; reciprocating a frame movable in a rectangular pattern and within the fixed frame, the reciprocating movement including a vertically movable portion bringing the frame into a lifting engagement with at least a substantial portion of the folded cartons and carrying the lifted cartons forwardly with a forward movement of the reciprocable frame, the movement pattern further including lowering of the frame sufficiently to bring the frame below the support means of the fixed frame and during this lowered movement moving the reciprocable frame rearwardly; delivering the folded cartons from their vertically supported condition to a generally horizontal condition in a delivery chute; providing a carton escapement apparatus in association with the delivery chute and reciprocably moving a carton stop whereat in a forward limit of movement this stop supports a forward edge of the lowermost carton in the horizontally disposed stack of folded cartons and when this carton stop is moved to and near its other limit of movement releasing the engaged edge of the lowermost carton and in a timed association with this movement of the carton stop providing an intermediate wedge-shaped entering blade and moving this blade counterflow to the movement of the carton stop, said blade disposed to enter that space between the lowermost carton and the next above carton as and before the carton stop is withdrawn from the stack supporting condition, and during the time the carton stop is withdrawn from supporting condition to support this immediately above and those additional above folded cartons, and advancing the wedge-shaped entering blade a determined distance in from the edge of the folded carton to insure that the variations in carton construction are overcome and the entering blade positively engages the edge of the folded carton.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position in which the carton feeding and transporting apparatus may be constructed or used.

While a particular embodiment of the feeding apparatus has in connection with a palletizer been shown and described it is to be understood the invention is not limited thereto since modifications may be made within the scope of the accompanying claims and protection is sought to the broadest extent the prior art follows.

What is claimed is:

1. Apparatus for receiving, transporting and presenting for withdrawal and the erection of folded cartons for use in case packing apparatus and the like, said apparatus including: (a) a fixed frame including side guides providing a support surface for receiving and maintaining folded cartons in a substantially side-by-side condition; (b) a reciprocating frame movable in a rectangular pattern and within the fixed frame, the movement including a vertically movable portion bringing the frame into a lifting engagement of at least one-eighth of an inch of the reciprocating frame above the fixed frame with at least a substantial portion of the folded cartons carried forwardly with a forward movement of the reciprocable frame, the movement pattern further including a lowering of the frame, of at least one-eighth of an inch of the reciprocating frame below the fixed frame to bring the frame below the support surface of the fixed frame and during this lowered movement the reciprocable frame is moved rearwardly, the reciprocating frame carried by a pair of axles having eccentrically formed ends which provide an eccentric motion of at least one-eighth inch throw and with antifriction rollers mounted on these ends, said rollers carrying the reciprocable frame on portions of the fixed frame so that when movable therealong the movable frame is moved in a path substantially parallel to the carton support surface provided by the fixed frame, and there is additionally provided means for simultaneously rotating the axles so that the eccentric ends at one limit of rotation of the axles are raised sufficiently to cause the rollers to lift the reciprocable frame and its carton support surface and at the other limit of rotation the axles are repositioned so that the eccentrically mounted rollers lower the carton support surface of the reciprocable frame below the carton support surface of the fixed frame; (c) means for moving the reciprocable frame forwardly and rearwardly with and by actuation of a hydraulic cylinder and there is provided limiting means on the hydraulic force whereby on the forward stroke a chute filled with folded cartons overcomes the propulsive force of the cylinder which is inhibited to the extent that a forward transport of the cartons does not occur as and until a sufficient amount of cartons has been withdrawn to permit other folded cartons to be moved forwardly to take the place of those withdrawn; (d) means for delivering the folded cartons from their vertically supported condition to a generally horizontal condition in said delivery chute; (e) a carton escapement apparatus in association with the delivery chute and having a carton stop reciprocably actuated by a single means whereat in one limit of movement this stop supports an outer edge of the lowermost carton in the horizontally disposed stack of folded cartons and when this carton stop is moved to and near its other limit of movement the engaged edge of the lowermost carton is released for removing from the stack and in a timed association with this movement of the carton stop there is provided an intermediate wedge-shaped entering blade which is moved counterflow to the movement of the carton stop, said blade movably disposed to enter that space between the lowermost carton and the next above carton as and with a sufficient time interval occurring before the carton stop is withdrawn from the stack supporting condition, and during the time the carton stop is withdrawn from supporting condition to support this immediately above and those additional above folded cartons, and (f) means for advancing the wedge-shaped entering blade a determined distance in from the edge of the folded carton to insure that the variations in carton construction are overcome and the entering blade positively engages the edge of the folded carton.

2. Apparatus for receiving, transporting and presenting folded cartons as in claim 1 in which the reciprocable frame is movable upwardly and downwardly with and by the actuation of a hydraulic cylinder which is moved by and in timed response to the back and forth movement of the reciprocable frame by the other hydraulic cylinder.

3. Apparatus for receiving, transporting and presenting folded cartons as in claim 2 in which the hydraulic cylinder that provides the back and forth movement and the hydraulic cylinder that provides the up and down movement of the reciprocable frame are pneumatic cylinders actuated by pressurized air.

4. Apparatus for receiving, transporting and presenting folded cartons as in claim 2 in which as the cartons are delivered they are disposed in a substantially vertical condition and as they are withdrawn from this stack they are inclined toward the horizontal with the forward edge released by an automatically actuated escapement mechanism which includes a hydraulic cylinder carried by the escapement frame and the rod end of this cylinder is operatively connected to an end of a lever means which is also operatively connected to the carton stop and also the wedge-shaped entering blade and the timed interval is provided by a lost motion means whereby the carton stop is maintained in carton engaging and retaining position as and until the wedge-shaped blade is fully entered between the ends of the folded cartons.

5. Apparatus for receiving, transporting and presenting folded cartons as in claim 4 in which the escapement mechanism further includes a resilient pad-like member carried by and with the wedge-shaped entering blade, said resilient member disposed to engage at least a few of the immediately above folded cartons at the outer edges thereof to maintain these cartons in retained condition as and when the wedge-shaped blade is entered between and in the carton supporting condition.

6. Apparatus for receiving, transporting and presenting folded cartons as in claim 5 in which the escapement mechanism further includes carrying the lowermost carton stop on a reciprocable member and in which the lost motion is provided by a spring which urges the carton stop member into supporting position during the time this stop supports the stack of catons, and against which spring bias the reciprocable member is moved as and when the wedge-shaped blade is moved into caton retaining position.

7. Apparatus for receiving, transporting and presenting folded cartons as in claim 6 in which the escapement mechanism further includes carrying the wedge-shaped entering blade on a reciprocable member which is operatively connected to the intermediate portion of the lever means and the reciprocable member carrying the lowermost carton stop is operatively connected to the same lever means at a point which is further from the hydraulic cylinder rod connection than is the operative connection to the reciprocable member carrying the wedge-shaped entering wedge.

8. Apparatus for receiving, transporting and presenting folded cartons as in claim 7 in which the hydraulic cylinder actuating the escapement mechanism is a pneumatic cylinder.

9. Apparatus for receiving, transporting and presenting folded cartons as in claim 8 in which the limiting means for determining the extent of advance of the wedge-shaped entering blade is an abutment carried by said blade.

10. Apparatus for receiving, transporting and presenting folded cartons as in claim 1 in which the withdrawing of the cartons from the stack is by suction conducted to cups each carried on and by a swinging arm, the suction source producing said suction actuated as and when the suction cups are pressed against the downward side of the lowermost carton in the mostly horizontal stack after which the arms and attached cups are moved so as to withdraw the carton from the stack.

11. Apparatus for receiving, transporting and presenting folded cartons as in claim 10 in which the suction source includes the producing of a suction stroke in a pneumatic cylinder actuated by a reciprocating means by which the erected cartons are transported.

12. Apparatus for receiving, transporting and presenting folded cartons as in claim 11 in which the source of suction includes an auxiliary vacuum producing means which is provided at the time the suction cups are initially pressed against the side of the lowermost carton.

13. Apparatus for receiving, transporting and presenting folded cartons as in claim 12 in which the auxiliary source of vacuum is provided by a venturi in which pressurized air is fed to the venturi during the initial suction producing portion of the stroke of the pneumatic cylinder, the auxiliary vacuum producing venturi action being terminated as and when the level of suction in the pneumatic cylinder and the connected system reaches a determined negative pressure.

14. A method for receiving, transporting and presenting for withdrawal and the erection of folded cartons for use in case packing apparatus and the like, said steps including: (a) providing a fixed frame including side guides establishing a support surface for receiving and maintaining folded cartons in a substantially side-by-side condition; (b) reciprocating a frame movable in a rectangular pattern and within the fixed frame, the reciprocating movement includng a vertically movable portion bringing the frame into a lifting engagement of at least one-eighth of an inch of the reciprocating frame above the fixed frame with at least a substantial portion of the folded cartons carried forwardly with a forward movement of the reciprocable frame, the movement pattern further including a lowering of the frame of at least one-eighth of an inch of the reciprocating frame below the fixed frame to bring the frame below the support surface of the fixed frame and during this lowered movement moving the reciprocable frame rearwardly, the raising and lowering of the reciprocable frame including carrying this frame by a pair of axles having eccentrically formed ends which provide an eccentric motion of at least one-eighth inch throw and with antifriction rollers mounted on these ends, said rollers carrying the reciprocable frame on portions of the fixed frame so that when movable therealong the movable frame is moved in a path substantially parallel to the carton support surface provided by the fixed frame, and simultaneously rotating the axles so that the eccentric ends at one limit of rotation of the axles cause the rollers to lift the reciprocable frame and its carton support so that the surface cartons engaged and carried thereby are lifted above the carton support surface of the fixed frame support, and at the other limit of rotation the axles are positioned so that the eccentrically mounted rollers lower the carton support surface of the reciprocable frame below the carton support surface of the fixed frame, the moving forwardly and rearwardly of this movable frame including actuating a hydraulic cylinder and providing a limiting means on the hydraulic force applied whereby on the forward stroke a chute filled with folded cartons overcomes the propulsive force of the cylinder which is inhibited to the extent that a forward transport of the cartons does not occur as and until a sufficient amount of cartons has been withdrawn to permit other folded cartons to be moved forwardly to take the place of those withdrawn from the chute; (c) delivering the folded cartons from their vertically supported condition to a generally horizontal condition in a delivery chute; (d) providing a carton escapement apparatus in association with the delivery chute and reciprocably moving by a single means a carbon stop whereat in a forward limit of movement this stop supports a forward outer edge of the lowermost carton in the horizontally disposed stack of folded cartons and when this carton stop is moved to and near its other limit of movement, releasing the engaged edge of the lowermost carton and in a timed association with this movement of the carton stop providing an intermediate wedge-shaped entering blade and moving this blade counterflow to the movement of the carton stop, said blade disposed to enter that space between the lowermost carton and the next above carton as and before the carton stop is withdrawn from the stack supporting condition, and with a sufficient time interval occurring during the time the carton stop is withdrawn from supporting condition to support this immediately above and those additional above folded cartons, and (e) advancing the wedge-shaped entering blade a determined distance in from the edge of the folded carton to insure that the variations in carton construction are overcome and the entering blade positively engages the edge of the folded carton.

15. The method of receiving, transporting and presenting folded cartons as in claim 16 in which as the cartons are delivered and disposed in a substantially vertical condition and as they are withdrawn from the chute they are inclined toward the horizontal with the forward edge released by an automatically actuated escapement mechanism which further includes carrying a hydraulic cylinder on the escapement frame and operatively connecting the rod end of this cylinder to an end of a lever means which is also operatively connected to the carton stop and also the wedge-shaped entering blade and additionally providing a lost motion means whereby the carton stop is maintained in carton engaging and retaining position as and until the wedge-shaped blade is fully entered between the ends of the folded cartons.

16. A method of receiving, transporting and presenting folded cartons as in claim 15 in which the escapement mechanism further includes providing a resilient pad-like member carried by and with the wedge-shaped entering blade, said resilient member engaging at least a few of the immediately above folded cartons at the outer edges thereof and maintaining these cartons in retained condition as and when the wedge-shaped blade is entered between and in the carton supporting condition.

17. The method of receiving, transporting and presenting folded cartons as in claim 14 in which the withdrawing of the cartons from the stack is by suction conducted to cups each carried on and by a swinging arm and producing this suction source as and when the suction cups are pressed against the downward side of the lowermost carton in the mostly horizontal stack after which the arms and attached cups are moved so as to withdraw the carton from the stack; the producing of a suction stroke is by actuating a pneumatic cylinder by a reciprocating means by which the erected cartons are transported, and providing an auxiliary vacuum at the time the suction cups are initially pressed against the side of the lowermost carton.

18. The method of receiving, transporting and presenting folded cartons as in claim 17 in which the auxiliary source of vacuum includes providing a venturi in which pessurized air is fed to the venturi during the initial suction producing portion of the stroke of the pneumatic cylinder, the auxiliary vacuum producing venturi action being terminated as and when the level of suction in the pneumatic cylinder and the connected system reach a determined negative pressure.

19. Apparatus for receiving, transporting and presenting for withdrawal and the erection of folded cartons for use in case packing apparatus having a fixed frame including side guides providing a support surface for receiving and maintaining folded cartons in a substantially side-by-side condition, and means for delivering the folded cartons from their vertically supported condition to a generally horizontal condition in a delivery chute, and in association with the delivery chute a carton escapement apparatus having a carton stop member reciprocably actuated by a single means whereat in one limit of movement this stop supports an outer edge of the lowermost carton in the horizontally disposed stack of folded cartons and when this carton stop is moved to and near its other limit of movement the engaged edge of the lowermost carton is released for removing from the stack and in a timed association with this movement of the carton stop there is provided an intermediate wedge-shaped entering blade which is moved counterflow to the movement of the carton stop, said blade movably disposed to enter that space between the lowermost carton and the next above carton as and with a sufficient time interval occurring before the carton stop is withdrawn from the stack supporting condition, and said apparatus including: (a) a pneumatic cylinder carried by said apparatus and having a rod end providing a pivoted mounting means; (b) a link arm pivotally attached to one end to the rod end of the cylinder and its other end pivotally connected to said reciprocably movable lowermost carton stop member; (c) a spring means carried by this lowermost carton stop member and so mounted as to urge a blade portion of this stop member toward and beneath the outer lowermost edge of the stack of folded cartons; (d) means to limit the forward motion of this lowermost carton stop to a determined position below and inward of the stack of cartons, and (e) an intermediate slide member carried by the escape apparatus and providing on its inward end the wedge-shaped entering blade and carton abutment, this intermediate slide member pivotally connected to the link arm at an intermediate portion thereof so that with a forward motion of the cylinder rod end the intermediate slide member is moved to enter that edge space between the lowermost and next above carton until the carton abutment on this entering blade engages the carton whereat the forward motion of the intermediate slide member stops and against the bias of the spring means further forward motion of the link arms causes the lowermost carton stop members to move from a supporting condition of the lowermost carton and as and after the lowermost carton has been withdrawn the movement of the rod end of the cylinder is reversed with the lowermost carton stop as urged by the bias of the spring means moving into carton supporting condition before counterflow motion and withdrawal is achieved of the intermediate slide member and its wedge-shaped entering blade from the edges of the cartons.

20. A method for receiving, transporting and presenting for withdrawal and the erection of folded cartons for use in case packing apparatus having a fixed frame including side guides providing a support surface for receiving and maintaining folded cartons in a substantially side-by-side condition and for delivering the folded cartons from their vertically supported condition to a generally horizontal condition in a delivery chute and in association with the delivery chute providing a carton escapement apparatus having a carton stop member reciprocably actuated by a single means whereat in one limit of movement this stop supports an outer edge of the lowermost carton in the horizontally disposed stack of folded cartons and when this carton stop is moved to and near its other limit of movement the engaged edge of the lowermost carton is released for removing from the stack and in a timed association with this movement of the carton stop there is provided an intermediate wedge-shaped entering blade which is moved counterflow to the movement of the carton stop, said blade movably disposed to enter that space between the lowermost carton and the next above carton as and with a sufficient time interval occurring before the carton stop is withdrawn from the stack supporting condition, and said method including the steps of: (a) carrying a pneumatic cylinder on said apparatus and providing a rod end with a pivoted mounting means; (b) attaching pivotally a link arm at one end to the rod end of the cylinder and its other end pivotally connecting said reciprocably movable lowermost carton stop member; (c) carrying a spring means on this lowermost carton stop member and as mounted to urge a blade portion of this stop member toward and beneath the outer lowermost edge of the stack of folded cartons; (d) limiting the forward motion of this lowermost carton stop to a determined position below and inward of the stack of cartons, and (e) carrying an intermediate slide member by the escape apparatus and providing on its inward end the wedge-shaped entering blade and carton abutment and pivotally connecting this intermediate slide member to the link arm at an intermediate portion thereof so that with a forward motion of the cylinder rod end the intermediate slide member is moved to enter that edge space between the lowermost and next above carton until the carton abutment on this entering blade engages the carbon whereat the forward motion of the intermediate slide member stops and against the bias of the spring means further forward motion of the link arms causes the lowermost carton stop members to move from a supporting condition of the lowermost carton and as and after the lowermost carton has been withdrawn the movement of the rod end of the cylinder is reversed with the lowermost carton stop as urged by the bias of the spring means moving into carton supporting condition before counterflow motion and withdrawal is achieved of the intermediate slide member and its wedge-shaped entering blade from the edges of the stack of cartons.

* * * * *